United States Patent [19]

Aho

[11] 4,343,491

[45] Aug. 10, 1982

[54] SNOW DISK FOR A SKI STICK

[75] Inventor: Yrjö Aho, Helsinki, Finland

[73] Assignee: Exel Oy, Finland

[21] Appl. No.: 126,647

[22] Filed: Mar. 3, 1980

[30] Foreign Application Priority Data

Feb. 16, 1979 [FI] Finland ..... 790526

[51] Int. Cl.[3] ..... A63C 11/02

[52] U.S. Cl. ..... 280/824

[58] Field of Search ..... 280/824, 819

[56] References Cited

U.S. PATENT DOCUMENTS 3,963,254 6/1976 Aho ..... 280/824

4,129,312 12/1978 Löffelholz ..... 280/824 X

FOREIGN PATENT DOCUMENTS 1267305 6/1961 France ..... 280/824

648945 1/1951 United Kingdom ..... 280/824

*Primary Examiner*—Joseph F. Peters, Jr.

*Assistant Examiner*—Michael Mar

*Attorney, Agent, or Firm*—Browning, Bushman & Zamecki

[57] ABSTRACT

A snow disk for a ski stick, the disk comprising a socket-shaped portion to be mounted on the stick and a rigid annular rim which is secured to the socket portion by radially directed flexible support ribs which yield so that the annular rim can pivot relatively to the socket portion.

4 Claims, 4 Drawing Figures

Fig. 3
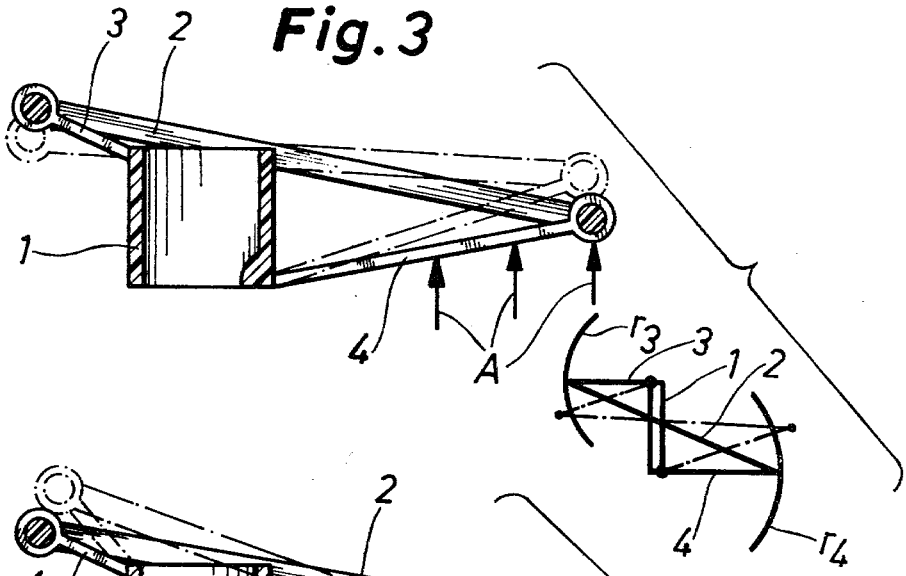
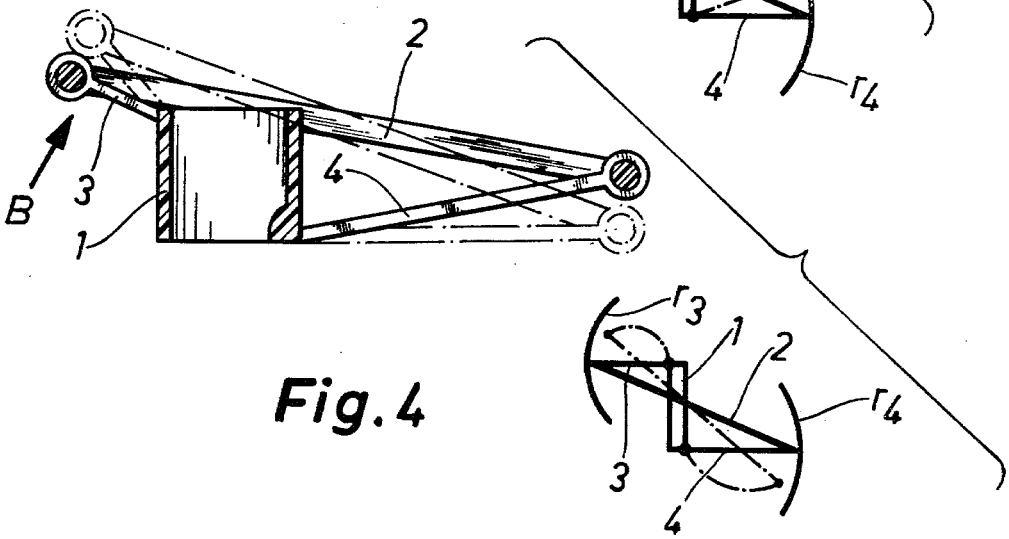
Fig. 4

SNOW DISK FOR A SKI STICK

BACKGROUND OF THE INVENTION

Snow disks of the type wherein the annular rim is secured to the socket portion by leather straps have been known for a long time. Recently this type of snow disks has been manufactured also of plastic. This type of snow disk is superior to all known disks where it is desirable to provide a large supporting surface in order to prevent the ski stick from plunging deep into a soft snow bank. Since it is readily pivotable relative to the ski stick, the disk can be given large surface area without its resisting the pivoting movement of the ski stick or causing the ski stick prong to bounce off the surface. With leather straps as support straps, there were no major drawbacks in the function of a ski stick. However, mostly for economic reasons, the tendency has been to switch to plastic materials also in this type of snow disks.

As a support rib material, however, plastic is stiffer than leather which is why the snow disk is no longer as readily pivotable relative to the ski stick. For example, in up-hill skiing, a result of this is that the front rim of a snow disk of large surface area meets the base preventing gripping of the prong, with the ski stick thus "slipping off." The front rim of the disk is also likely to make the ski stick prong bounce off the base toward the end of the thrust with the stick in inclined position, whereby the thrust cannot be completed with full force. This, of course, gives rise to the idea of positioning the awkward front rim of the disk near the ski stick, as disclosed in applicant's U.S. Pat. No. 3,963,254. It should be noted, however, that the solution known from the patent deals with a stiff plastic snow disk which is why shifting of the disk front rim is possible. This is not the case with the present snow disk which is readily pivotably attached to the ski stick by means of flexible radial support ribs. If such a disk is placed asymmetrically relative to the stick, a result will be uneven load distribution on the disk surface and a readily pivotable snow disk will turn to the position nearly parallel to the stick, whereby the disk will dive with the front rim leading into a snow bank. In such a situation, a large supporting surface is of no use. Thus, there has been no way of utilizing in readily pivotable snow disks those advantages of an asymmetrical disk that are achieved in stiff plastic snow disks.

SUMMARY OF THE INVENTION

The object of the invention is to provide a well-supporting snow disk of the above-mentioned type provided with large surface area, which disk can be made of plastic material in asymmetrical shape without said risk of diving whereby advantage can be made of (1) inexpensive manufacturing offered by plastic material, (2) good supporting capability offered by large surface area, and (3) overcoming the drawbacks resulting from a projecting leading rim.

For this object the above-mentioned type of a disk is characterized in that shorter support ribs are secured to the upper edge of the socket portion and longer support ribs, positioned on the opposite side of the socket portion, are secured to its lower edge, the socket portion and support ribs together forming a letter Z-shaped figure in side view. A consequence of this is that the snow disk can readily pivot in just one direction, in which shorter support ribs pivot upward and longer support ribs downward, but turning of the disk in the opposite direction is strongly resisted. This is due to the fact that pivoting the disk in the latter direction would require stretching of the support ribs and/or squeezing of the stiff annular rim into oval shape which, on the other hand, would require stretching of the transversely extending support ribs. Since stretching of the support ribs requires considerable force, the disk resists with significant force such pivoting movement that longer support ribs would turn upward and the shorter ones downward. Thus, despite its asymmetrical design the snow disk can be loaded with considerable force against the base without any danger of the disk pivoting into a position in which it would dive into snow. In contrast, the shorter support ribs can easily pivot upward and the longer ones respectively downward since there is a pressure load applied to the support ribs and tending to shorten them, there being hardly any resistance at all to said pressure load since the support ribs can readily bend into curved shape. Thus, the leading rim of an asymmetrical snow disk can be positioned immediately adjacent the ski stick and, in addition, it is readily flexible upward, so even in skiing steep up-hill the ski stick prong will get a solid grip in the base. At the same time, the prong portion can be considerably shortened which also facilitates the pivoting movement of the stick since the part of the stick pivoting in snow will remain short.

BRIEF DESCRIPTION OF THE DRAWINGS

A preferred embodiment of the invention will be described in the following with reference made to the accompanying drawing, in which:

FIGS. 3 and 4 depict the function of the snow disk in various loading situations.

DESCRIPTION OF THE PREFERRED EMBODIMENT

Figure 1:
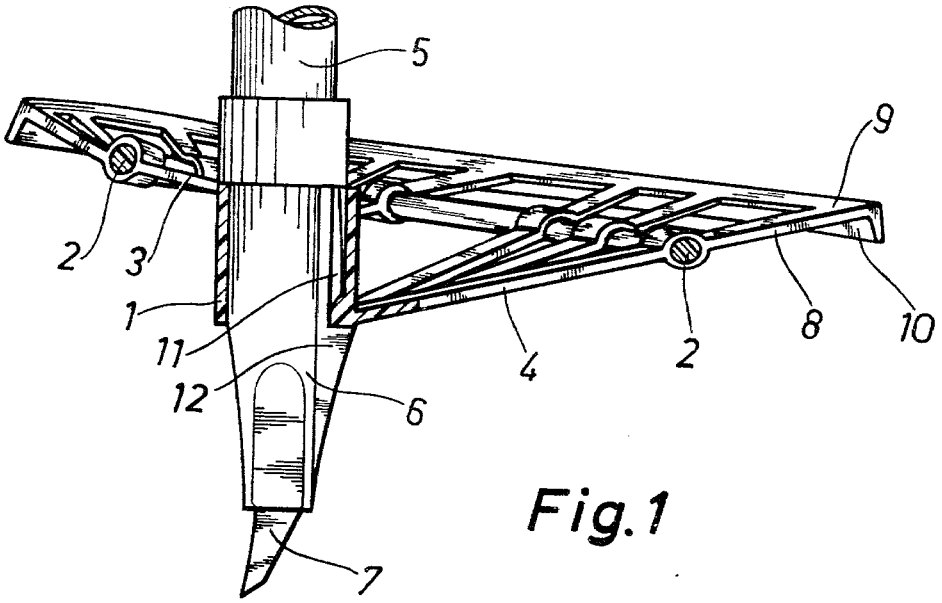
FIG. 1 shown a snow disk of the invention in cross-section and mounted on a ski stick.
Figure 2:
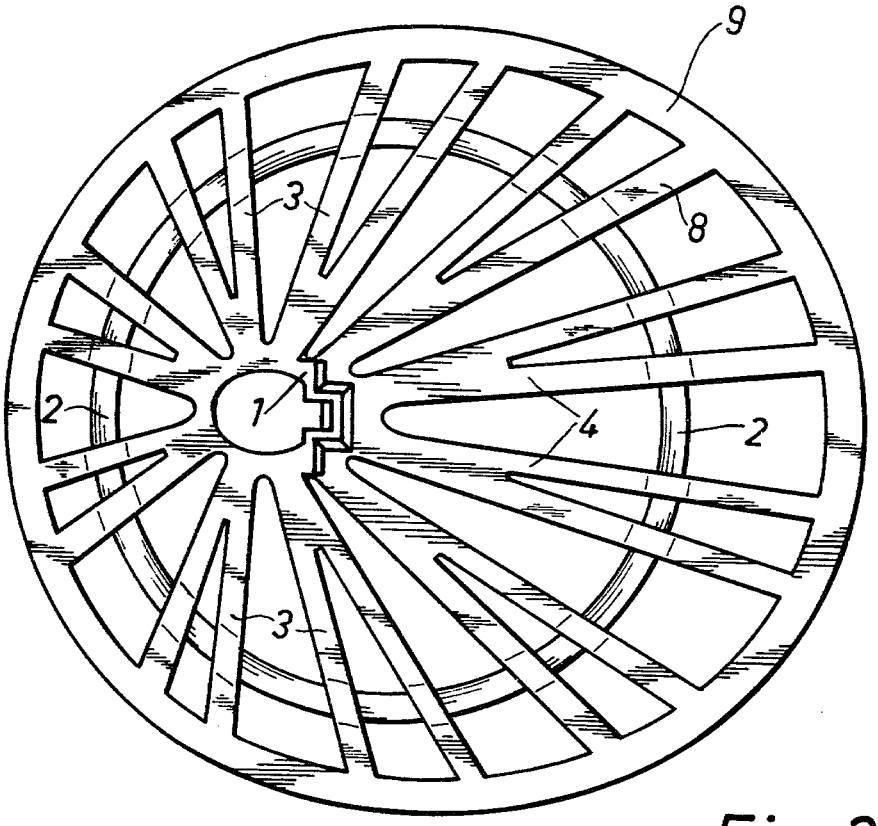
FIG. 2 is a plan view of the same snow disk.

The disk is provided with a socket-shaped portion 1 and an annular rim 2 of stiff plastic secured to the socket portion 1 by means of radial support ribs 3 and 4. The lower end of a ski stick 5 is provided with a plastic fitting 6 around which the socket portion 1 engages. The disk has been non-rotatably locked in position by means of a wedge 11 inserted in a keyway of the socket portion 1. A cam 12 maintains the disk axially in position. Furthermore, the fitting 6 is provided with an embedded metal prong 7.

Support ribs 3 an 4 are made of a soft flexible plastic material, while the annular rim 2 is of hard and stiff plastic. On the leading side of the disk, on the opposite side of the stick 5 with respect to a wriststrap, not shown, the support ribs 3 are shorter and secured to the upper edge of the socket portion 1. On the opposite side, i.e. on the trailing side of the disk, the support ribs 4 are substantially longer, for example, more than twice as long and preferably approximately three times as long as the support ribs 3, in addition to which, the longer support ribs 4 are secured to the lower edge of the socket portion 1.

In the present embodiment, the support ribs 3 and 4 have been extended beyond the annular rim 2 and these extensions 8 terminate in an outer annular rim 9, which is made of the same soft and flexible plastic material as the support ribs 3, 4 and 8. Moreover, the outer annular rim 9 is fitted with a downward expanding, frusto-conical hem 10 which, due to the flexibility of the plastic material, will expand when the snow disk is pressed against the base, thus further adding to the supporting surface of the disk.

An essential feature in the invention is provision of flexible support ribs 3 and 4 between a stiff annular rim 2 and a socket portion 1 so as to provide a snow disk which is readily pivotable in one direction but resists pivoting in the other.

When pressing the disk against the base, the asymmetrical design of the disk results in the loading being substantially applied to the trailing rim of the disk, as depicted by arrows A in FIG. 3. This loading tends to switch the disk into a position illustrated by dotted lines. As can be appreciated especially from the reduced diagram of FIG. 3, such pivoting movement would result in stretching of the support ribs 3 and 4, since the diameter of the annular rim 2, i.e. the distance between the outer ends of support ribs remains unchanged. Reference characters $r_3$ and $r_4$ in the FIG. 3 diagram represent the circular arcs along which the outer ends of support ribs 3 and 4 can move without being stretched.

When turning the ski stick forward during the trust or with the leading rim of the disk hitting the ground, e.g. on deep uphill, there is a force applied to the leading rim of the disk, said force being designated by an arrow B in FIG. 4. In this case, the disk is readily able to switch into a position depicted by dotted lines (or to even steeper angle in which the leading rim of the disk responds to the ski stick 5). As depicted in the FIG. 4 diagram, this happens because the outer ends of support ribs 3 and 4 are forced by the annular rim 2 closer to each other as compared to the situation where they are moving along circular arcs $r_3$ and $r_4$. However, since support ribs 3 and 4 hardly at all resist the bending, the switching of the disk into the dotted line position of FIG. 4 is readily effected. In the FIG. 4 diagram the bending of support ribs 3 amd 4 has been considerably exaggerated since in practical conditions there is little or no bending but, instead, the disk only tends to pivot more easily in one direction than the other without visible deformations.

In manufacture of the disk, a prefabricated annular rim 2 can be positioned in a mold cavity for the rest of the disk during the casting operation, the annular rim 2 being permanently molded in the ends of support ribs 3 and 4. The present snow disk is usable also without the rim portion extending beyond the annular rim 2 but for maximum supporting capacity the use of this extra rim portion is desirable.

I claim:

1. A snow disk for a ski stick, comprising a socket-shaped portion (1) for mounting on a ski stick (5, 6), said socket portion (1) having an upper edge and a lower edge, and a stiff annular rim (2) having a leading portion and a trailing portion and secured to the socket portion (1) by means of radially extending first and second, flexible support ribs (3, 4) which yield so that the annular rim (2) can pivot relative to the socket portion (1), characterized in that said first support ribs (3) are secured generally to the leading portion of said rim (2) and the upper edge of the socket portion (1) and said second support ribs (4) are secured generally to the trailing portion of said rim (2) and the lower edge of the socket portion (1), said first support ribs (3) being shorter than said second support ribs (4), said socket portion (1) and the support ribs (3, 4) together being generally Z-shaped in side view.

2. A snow disk for a ski stick according to claim 1, characterized in that the radial support ribs (3, 4) extend a small distance beyond the stiff annular rim (2), whereby they integrally merge together with an outer annular rim (9) made of the same flexible material.

3. A snow disk for a ski stick according to claim 2, characterized in that the outer annular rim (9) is fitted with a downwardly expanding frusto-conical hem (10).

4. A snow disk for a ski stick according to claim 1, characterized in that the shortest support ribs (3) are more than twice, preferably approximately three times, shorter than the longest support ribs (4).

* * * * *